US007988419B1

(12) United States Patent
Liang

(10) Patent No.: US 7,988,419 B1
(45) Date of Patent: Aug. 2, 2011

(54) TURBINE BLADE WITH SERPENTINE FLOW COOLING

(75) Inventor: George Liang, Palm Clty, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 486 days.

(21) Appl. No.: 12/335,394

(22) Filed: Dec. 15, 2008

(51) Int. Cl.
*F01D 5/08* (2006.01)

(52) U.S. Cl. ..... 416/97 R; 416/96 R

(58) Field of Classification Search ..... 416/96 R, 416/97 R; 415/115, 116
See application file for complete search history.

(56) References Cited

U.S. PATENT DOCUMENTS 5,397,217 A * 3/1995 DeMarche et al. ..... 416/97 R
5,873,695 A * 2/1999 Takeishi et al. ..... 415/115
5,902,093 A * 5/1999 Liotta et al. ..... 416/97 R
6,186,741 B1 * 2/2001 Webb et al. ..... 416/96 R
6,220,817 B1 * 4/2001 Durgin et al. ..... 416/97 R
6,290,463 B1 * 9/2001 Fargher et al. ..... 416/97 R
7,296,972 B2 * 11/2007 Liang ..... 416/97 R
2006/0222493 A1 * 10/2006 Liang ..... 416/97 R

* cited by examiner

*Primary Examiner* — Kiesha Bryant
*Assistant Examiner* — Mark Tornow
(74) *Attorney, Agent, or Firm* — John Ryznic

(57) ABSTRACT

A large and highly twisted turbine blade for an IGT having a lower span serpentine flow cooling circuit and an upper span serpentine flow cooling circuit connected in series to provide low flow cooling for the blade. The lower span serpentine is a forward flowing 5-pass serpentine, while the upper span is an aft flowing 3-pass serpentine circuit. The last leg of the lower span serpentine and the first leg of the upper span serpentine are both aligned along the leading edge region to provide cooling there. The trailing edge includes lower span exit cooling holes and upper span exit cooling holes in which the lower span exit holes are connected to the first leg of the lower span serpentine and the upper span exit holes are connected to the last leg of the upper span serpentine. All of the cooling air from the lower span serpentine circuit that does not flow out the lower span exit holes flows into the upper span serpentine circuit to provide low flow cooling with the lower span cooled before the upper span.

13 Claims, 2 Drawing Sheets

TURBINE BLADE WITH SERPENTINE FLOW COOLING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a large air cooled turbine blade.

2. Description of the Related Art Including, Information Disclosed Under 37 CFR 1.97 and 1.98

A gas turbine engine of the type used in electrical power production includes a turbine section with three or four stages or rows of rotor blades. The last stage rotor blades are very large. The prior art cooling of a large turbine rotor blade is achieved by drilling radial holes into the blade from the tip and root sections. Limitation of drilling a long radial hole from both ends of the airfoil increases for a large and highly twisted and tapered blade airfoil. Reduction of the available airfoil cross section area for drilling radial holes is a function of the blade twist and taper. Higher airfoil twist and taper yield a lower available cross sectional area for drilling radial cooling holes. Cooling of the large and highly twisted and tapered blade by this manufacturing process will not achieve the optimum blade cooling effectiveness. Especially effective cooling for the airfoil leading and trailing edges are difficult to achieve. the prior art process for producing large and highly twisted turbine blades prevent a blade that can be used in a high temperature environment or with the use of low cooling flow, both of which the future requires for next generation industrial gas turbine engines.

BRIEF SUMMARY OF THE INVENTION

It is an object of the present invention to provide for a large and highly twisted turbine rotor blade with low flow cooling capability.

the present invention is a large turbine blade having a large amount of twist and taper, where the blade includes an internal cooling circuit formed by a 5-pass forward flowing serpentine cooling circuit in the lower blade span and an aft flowing 3-pass serpentine cooling circuit in the upper blade span both being connected in series such that cooling air flows in the lower span serpentine to cool the lower portion first, and then flows into the upper span serpentine to provide cooling for the upper span section.

Exit cooling holes are arranged along the trailing edge to provide cooling for this section of the airfoil, and both the lower span and upper span serpentine cooling circuits supply cooling air to the exit holes in the lower span, some of the cooling air is bled off for use in the exit holes, while in the upper span all of the cooling air flowing through the upper span serpentine circuit flows out the exit holes.

DETAILED DESCRIPTION OF THE INVENTION

Figure 1:
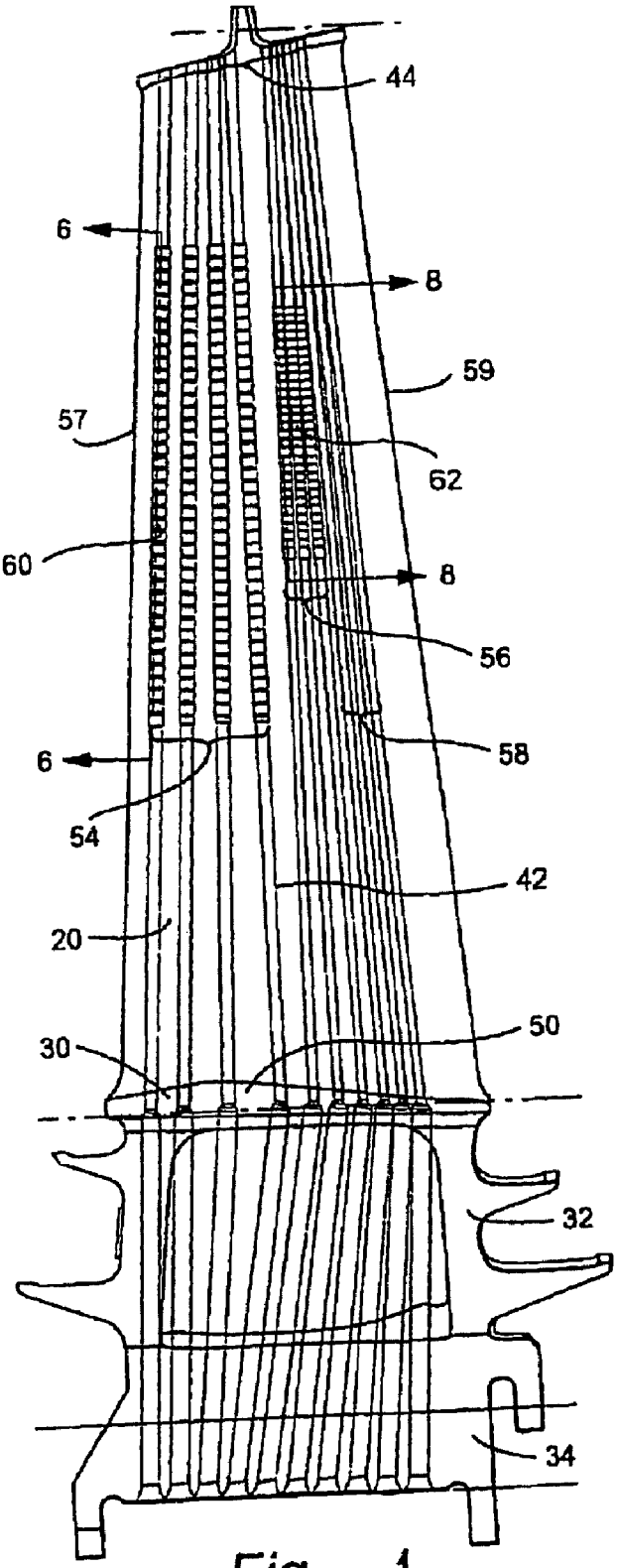
FIG. 1 shows a cross section view of a prior art large turbine blade codling circuit.
Figure 2:
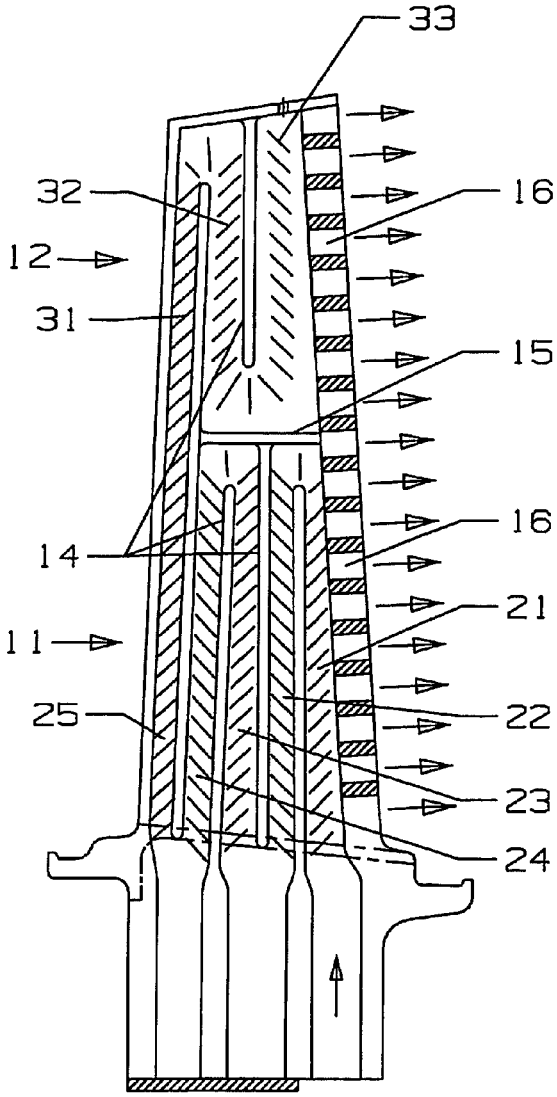
FIG. 2 shows a cross section view of the twin serpentine flow cooling circuit of the present invention.

The present invention is a cooling circuit for a large turbine rotor blade for an industrial gas turbine engine where the blade has a large amount of twist and taper such that drilling radial cooling holes would be prohibitive. The twin serpentine flow cooling circuit of the present invention is shown in FIG. 2 and includes a lower span serpentine flow circuit 11 and an upper span serpentine flow cooling circuit 12, where the cooling air for the upper span serpentine circuit 12 is supplied from the lower span serpentine flow circuit 11.

The lower span serpentine flow circuit 11 is a 5-pass serpentine flow circuit in which the first pass or leg 21 is located along the trailing edge region and forms a forward flowing serpentine circuit. The lower span serpentine circuit 11 includes a second leg 22, third leg 23, fourth leg 24 and fifth leg 25 all connected in series. The fifth leg 25 is arranged along the leading edge portion of the airfoil. Cooling air supplied to the lower span serpentine circuit 11 is supplied from an external source, such as the compressor; to, a cooling air supply channel 13, formed within the circuit of the blade. The separation point between the upper span and the lower span of the airfoil can vary depending upon the heat load on the airfoil, the required cooling, and other factors used in the design of the cooling-circuits.

The upper span serpentine circuit 12 is a 3-pass serpentine flow cooling circuit that flows in the aft direction, and includes a first leg 31 which is a continuation of the fifth leg 25 of the lower span serpentine circuit 11. The upper span serpentine circuit 12 includes a second leg 32 and a third leg 33 to form the serpentine flow circuit in which the third leg 33 is arranged along the trailing edge portion of the airfoil. spanwise ribs 14 separate all of the legs in both serpentine flow circuits, and a chordwise extending rib 16 separates the lower serpentine circuit 11 form the upper serpentine circuit 12. The ribs and the serpentine flow legs are all cast into the blade during the investment casting process. Trip strips or other turbulent-flow promoters are includes along the walls of the serpentine flow circuits to promote heat transfer to the cooling air flow.

Spaced along the trailing edge region of the airfoil is a row of exit cooling holes or cooling slots 16 that provide cooling for the trailing edge region the exit slots 16 extend from the platform all the way to the blade tip and are connected to the last legs of the two serpentine flow circuits. Cooling air supplied to the lower serpentine flow circuit flows into the first leg 21 in which some of the cooling air flows out through the exit slots arranged on the lower span of the airfoil. the remaining cooling air continues through the remaining parts of the lower serpentine flow circuit 11, and then flows into the first leg 31 of the upper span serpentine circuit 12 to provide cooling for the upper span of the airfoil. The cooling air from the third leg 33 of the upper span serpentine circuit then flows out through the upper span exit slots 16 to be discharged out from the airfoil cooling circuit.

Figure 3:
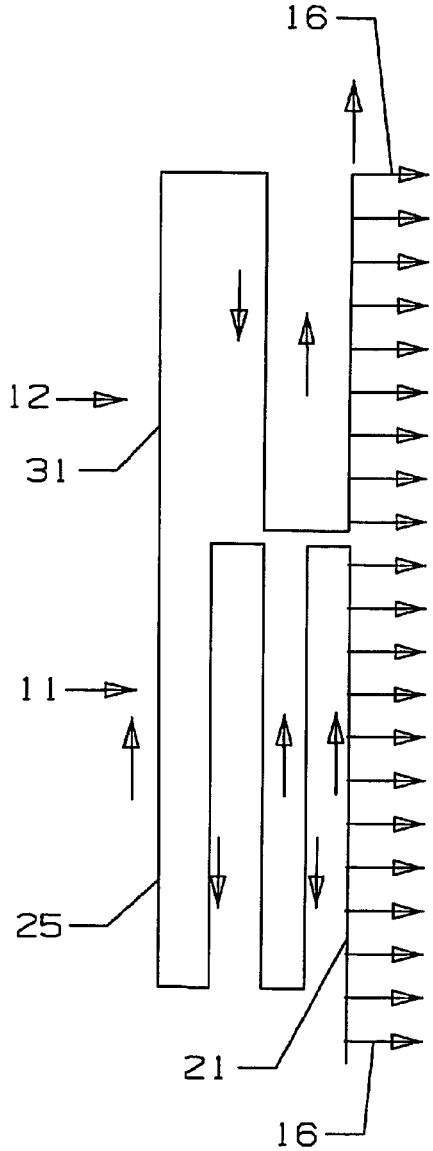
FIG. 3 shows a diagram of the twin serpentine flow cooling circuit of the present invention from FIG. 2.

FIG. 3 shows a diagram view of the cooling circuits of the present invention. The arrows represent the cooling flow direction in the circuits. The exit holes 16 extend along the entire trailing edge section of the blade airfoil in this particular embodiment, the two serpentine circuits are shown as a 5-pass lower serpentine and a 3-pass upper serpentine. However, other arrangements with less or more passes can possibly be used to provide cooling for the entire airfoil. However, the arrangement shown is considered to provide the highest level of cooling for a large airfoil while using the lowest amount of cooling air to provide a high level of cooling effectiveness for these larger turbine blades. A tip cooling hole is shown in FIG. 3 that also discharges cooling air from the third leg 33 of the upper span serpentine circuit out through the blade tip. tip cooling holes can also be used at the transition between the first leg 31 and the second leg 32 to provide additional tip cooling if warranted.

The turbine airfoil normally includes a large cross sectional area at the blade lower span and is tapered to a small blade thickness at the upper span height. A 5-pass forward flowing serpentine circuit is thus used for the blade lower span circuit with built-in channel trip strips for the augmentation of cooling side internal heat transfer coefficient. Cooling air is fed through the airfoil trailing edge first to provide a low metal temperature requirement for the trailing edge root section. Partitioning the tall blade into two halves and cooling the lower half first without circulating the cooling air to the upper span to heat up the cooling air first will yield a higher creep capability for the blade than the prior art radial channels.

An aft flowing 3-pass serpentine, circuit is used in blade upper span. The inlet for the upper span serpentine circuit is connected to the exit of the lower span serpentine circuit. Although the cooling air is used for the cooling of the blade lower span first, due to the lower pull stress and a higher allowable metal temperature for the blade upper span, the use of the cooling air for the cooling of the lower span first and then for cooling the upper span after represent a balanced blade cooling design. The 3-pass (triple pass) serpentine flow circuit is finally discharged through the airfoil trailing edge by a row of metering holes located along the trailing edge in the blade upper span section. Trip strips are incorporated into the aft flowing serpentine circuit channels for the enhancement of internal heat transfer performance. The entire turbine blade with the twin serpentine flow cooling circuits and the strip strips and exit cooling holes can be cast as a single integral part using the well-known investment casting process to produce the large and highly twisted and tapered turbine blade with low flow cooling circuit to produce adequate cooling for the blade.

The major advantages of the twin serpentine flow cooling circuit of the present invention over the prior art drilled radial cooling holes are listed below. partition of the blade into two halves allow for the use of a dual serpentine flow cooling design and with the use of re-circulated heated cooling air for use in the blade upper span section. Serpentine cooling yields a higher cooling effectiveness level than the drilled radial holes. The 5-pass serpentine cooling circuit yields a lower and more uniform blade sectional mass average temperature for the blade lower span which improves blade creep life capability. The forward flowing serpentine circuit with trailing edge exit holes provides for a cooler cooling air for the blade root section and therefore improves the airfoil high cycle fatigue (HCF) capability. HCF is fatigue over one million cycles, while low cycle fatigue (LCF) is fatigue from less than one hundred thousand cycles. The cooling circuit of the present invention provides cooling for the airfoil thin section and thus improves the airfoil oxidation capability and allows for a higher operating temperature for the future engine upgrade. The use of cooling air to cool the blade lower span first and then to cool the blade upper span is inline with the blade allowable temperature profile.

I claim the following:

1. A large turbine blade comprising:

a root section with a cooling air supply channel formed therein;

an airfoil portion extending from the root section and having a lower span section and an upper span section;

a forward flowing serpentine flow cooling circuit located in the lower span of the airfoil to provide internal cooling for the lower span of the airfoil;

an aft flowing serpentine flow cooling circuit located in the upper span of the airfoil to provide internal cooling for the upper span of the airfoil; and, a last leg of the lower span serpentine flow cooling circuit and a first leg of the upper span serpentine flow cooling circuit being one long channel extending from near the root to near the tip of the airfoil and positioned along the leading edge of the airfoil.

2. The large turbine blade of claim 1, and further comprising:

the large turbine blade is an industrial gas turbine engine blade for the last stage of the turbine.

3. The large turbine blade of claim 1, and further comprising:

the large turbine blade is a highly twisted and highly tapered turbine blade.

4. The large turbine blade of claim 1, and further comprising:

a row of lower span exit cooling holes connected to the first leg of the lower span serpentine flow cooling circuit; and, a row of upper span exit cooling holes connected to the last leg of the upper span serpentine flow cooling circuit.

5. The large turbine blade of claim 1, and further comprising:

the lower span serpentine circuit is a 5-pass serpentine circuit.

6. The large turbine blade of claim 5, and further comprising:

the upper span serpentine circuit is a 3-pass serpentine circuit.

7. The large turbine blade of claim 1, and further comprising:

a blade tip cooling hole connected to the last leg of the upper span serpentine flow cooling circuit.

8. The large turbine blade of claim 7, and further comprising:

the lower span serpentine flow cooling circuit and the upper span serpentine flow cooling circuit form a closed cooling circuit except for the exit cooling holes and the tip cooling hole.

9. The large turbine blade of claim 7, and further comprising:

the turbine blade with the lower span and the upper span serpentine cooling circuits is formed as a single piece by an investment casting process.

10. The large turbine blade of claim 1, and further comprising:

the upper span and the lower span serpentine flow cooling circuits include trip strips along the walls of the legs to promote heat transfer.

11. A process for cooling a large and highly twisted turbine blade comprising the steps of:

supplying pressurized cooling air to the turbine blade root section;

passing the cooling air through a serpentine flow cooling circuit located in the lower span of the airfoil in a forward flowing direction;

bleeding off a portion of the cooling air through a row of exit holes in the trailing edge in the lower span of the airfoil;

passing the remaining cooling air through an aft flowing serpentine cooling circuit located in the upper span of the airfoil; and, discharging most of the cooling air from the upper span serpentine flow through exit cooling holes in the upper span of the trailing edge of the airfoil.

12. The process for cooling a large and highly twisted turbine blade of claim 11, and further comprising the step of:

discharging some of the cooling air from the upper span serpentine circuit from the last leg through a blade tip cooling hole.

13. The process for cooling a large and highly twisted turbine blade of claim 11, and further comprising the step of:

cooling the leading edge region of the airfoil with the cooling air flowing in the last leg of the lower span serpentine flow circuit and the first leg of the upper span serpentine flow circuit.

* * * * *